US006634911B1

(12) United States Patent
Billman et al.

(10) Patent No.: US 6,634,911 B1
(45) Date of Patent: Oct. 21, 2003

(54) CONTACT FOR ELECTRICAL CONNECTOR

(75) Inventors: Timothy B. Billman, Dover, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/165,576

(22) Filed: Jun. 7, 2002

(51) Int. Cl.[7] ..... H01R 9/24
(52) U.S. Cl. ..... 439/884; 439/83; 439/637
(58) Field of Search ..... 439/884, 342, 439/637, 638, 82, 83, 857

(56) References Cited

U.S. PATENT DOCUMENTS 4,317,609 A * 3/1982 Lapraik ..... 439/733.1
4,498,725 A * 2/1985 Bright et al. ..... 439/347
5,399,108 A * 3/1995 Lu et al. ..... 439/682
6,142,810 A * 11/2000 Hsiao et al. ..... 439/342
6,247,954 B1 * 6/2001 Ju ..... 439/342
6,439,934 B1 * 8/2002 Yu ..... 439/733.1
6,450,826 B1 * 9/2002 Howell et al. ..... 439/342
6,450,844 B1 * 9/2002 Mizumura et al. ..... 439/884
6,461,183 B1 * 10/2002 Ohkita et al. ..... 439/342

* cited by examiner

*Primary Examiner*—Tulsidas Patel
(74) *Attorney, Agent, or Firm*—Wei Te Chung

(57) ABSTRACT

A contact (1) comprises a main portion (11,) a pair of retaining portions 13 extending from a pair of ends of the main portion and substantially perpendicular to the main portion, a pair of compressive tail portions (15) extending from the retaining portions, a pair of arms (14) expending upwardly from top ends of the retaining portions, a pin-like tail portion (12) extending downwardly from the main portion. The compressive tail portions are adapted to electrically connect with a circuit trace on a PCB and the pin-like portion has a length adapted for extending through the PCB

13 Claims, 4 Drawing Sheets

CONTACT FOR ELECTRICAL CONNECTOR

CROSS-REFERENCE TO RELATED APPLICATION

This patent application is a Co-pending Application of patent application Ser. No. 10/152,540 filed on May 20, 2002, entitled "CONTACT FOR ELECTRICAL CONNECTOR", invented by the same inventors, assigned to the same assignee and filed on the same date with this application.

BACKGROUND OF THE INVENTION

1. Field of the Invention

The present invention relates to a contact for use in an electrical connector, and particularly to a contact used in an electrical connector for electrically connecting with a printed circuit board (PCB).

2. Description of Related Art

For firmly assembling to a PCB, specialized means are designed to secure contacts engaging in through holes of the PCB. Usually, the contacts have needle-eyed tails which can be press-fitted into the through holes of the PCB. Thus, a connector having the contacts is secured in the PCB too. However, as more contacts with needle-eyed tails are used, a larger insertion force is needed to mount the connector to the PCB. In a backplane application, the connector has a large number of contacts which need to engage with the PCB. In such an application, if the contacts are designed to have the needle-eye tails, the large insertion force for mounting the connector to the printed circuit board may damage the PCB and the contacts. An improved contact for the backplane application is needed to solve this problem.

SUMMARY OF THE INVENTION

An object of the present invention is to provide an electrical contact for use in a backplane connector, wherein the connector can be securely mounted to a printed circuit board without the necessity of applying a large insertion force to the connector.

To achieve the above-mentioned objects, an electrical contact in accordance with the present invention comprises a main portion, a pair of retaining portions extending from a pair of ends of the main portion and substantially perpendicular to the main portion, a pair of compressive tail portions extending from the retaining portions, a pair of arms expending upwardly from top ends of the retaining portions, a pin-like tail portion extending downwardly from the main portion. The compressive tail portions are adapted to electrically connect with a circuit trace on a PCB and the pin-like portion has a length adapted for extending through the PCB.

Other objects, advantages and novel features of the invention will become more apparent from the following detailed description of the present embodiment when taken in conjunction with the accompanying drawings.

DETAILED DESCRIPTION OF THE INVENTION

Figure 1:
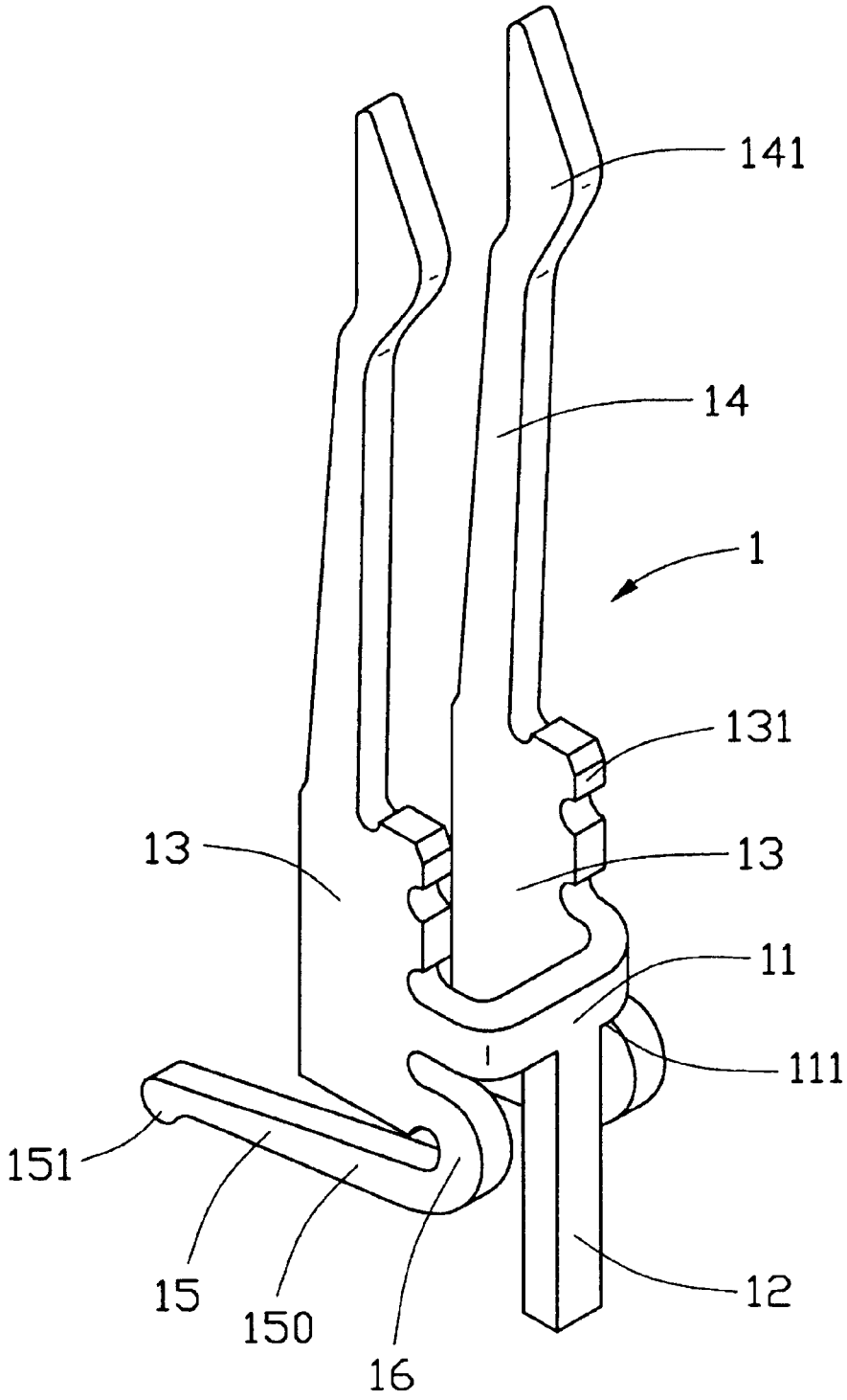
FIG. 1 is a perspective view of an electrical contact in accordance with the present invention.
Figure 3:
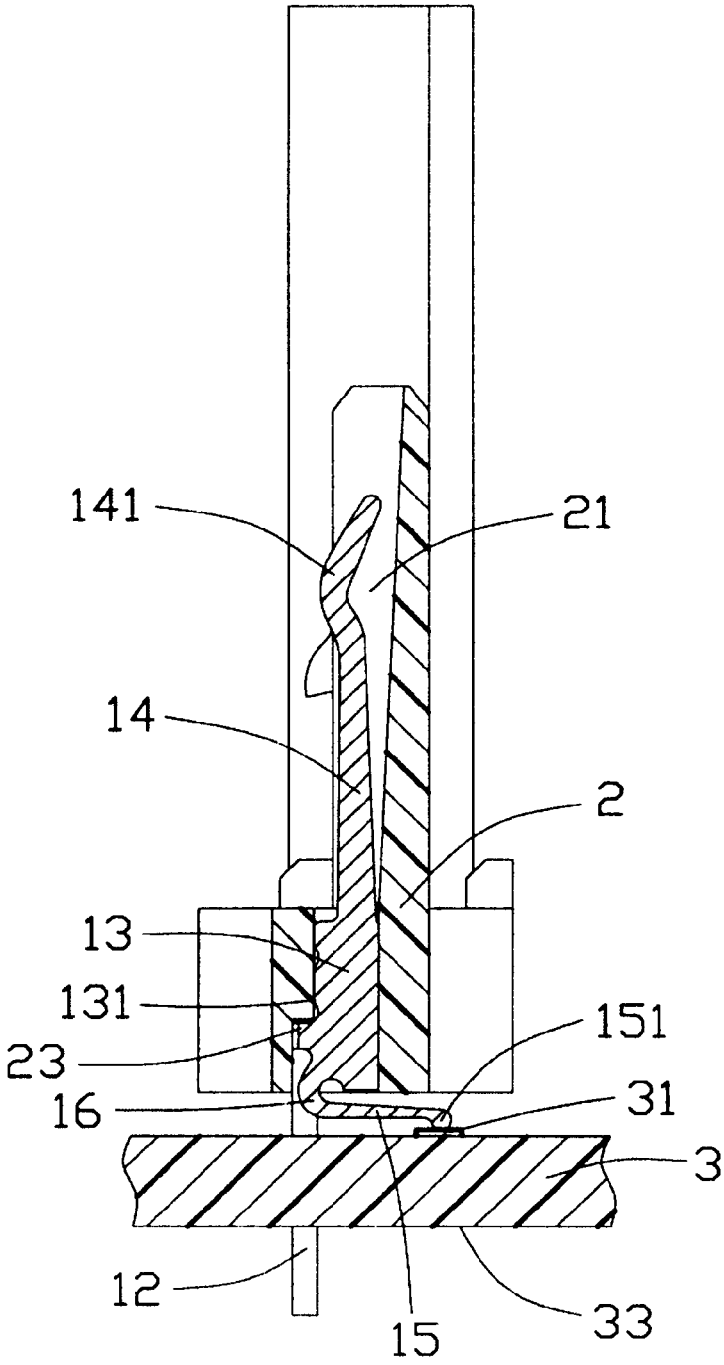
FIG. 3 is a cross-sectional view taken along line 3—3 of FIG. 2.

Referring to FIG. 1, a conductive contact 1 in accordance with the present invention comprises a main portion 11. A pair of retaining portions 13 extends rearward from opposite transverse ends of the main portion 11 and substantially perpendicularly to the main portion 11. The retaining portions 13 each have two teeth 131 formed on a front edge thereof. A compressive tail portion 15 extends from a lower part of the front edge of each retaining portion 13. Each compressive tail portion has a curved portion 16 located in front of the front edge of a corresponding retaining portion 13. A leg 150 extends declinedly from a lower end of the curved portion 16. The leg 150 has a downwardly bulge 151 at a rear free end thereof for compressively engaging a conductive pad 31 on a printed circuit board (FIG. 3). Each tail portion 15 extends rearward to substantially perpendicular to the main portion 11 and located at a same plane with the corresponding retaining portion 13. A pair of arms 14 extends upwardly from top ends of the retaining portions 13. Each arm 14 has a curved contacting portion 141 at a top end thereof. A pin-like tail portion 12 extends downwardly from a middle of a lower edge 111 of the main portion 11.

Figure 2:
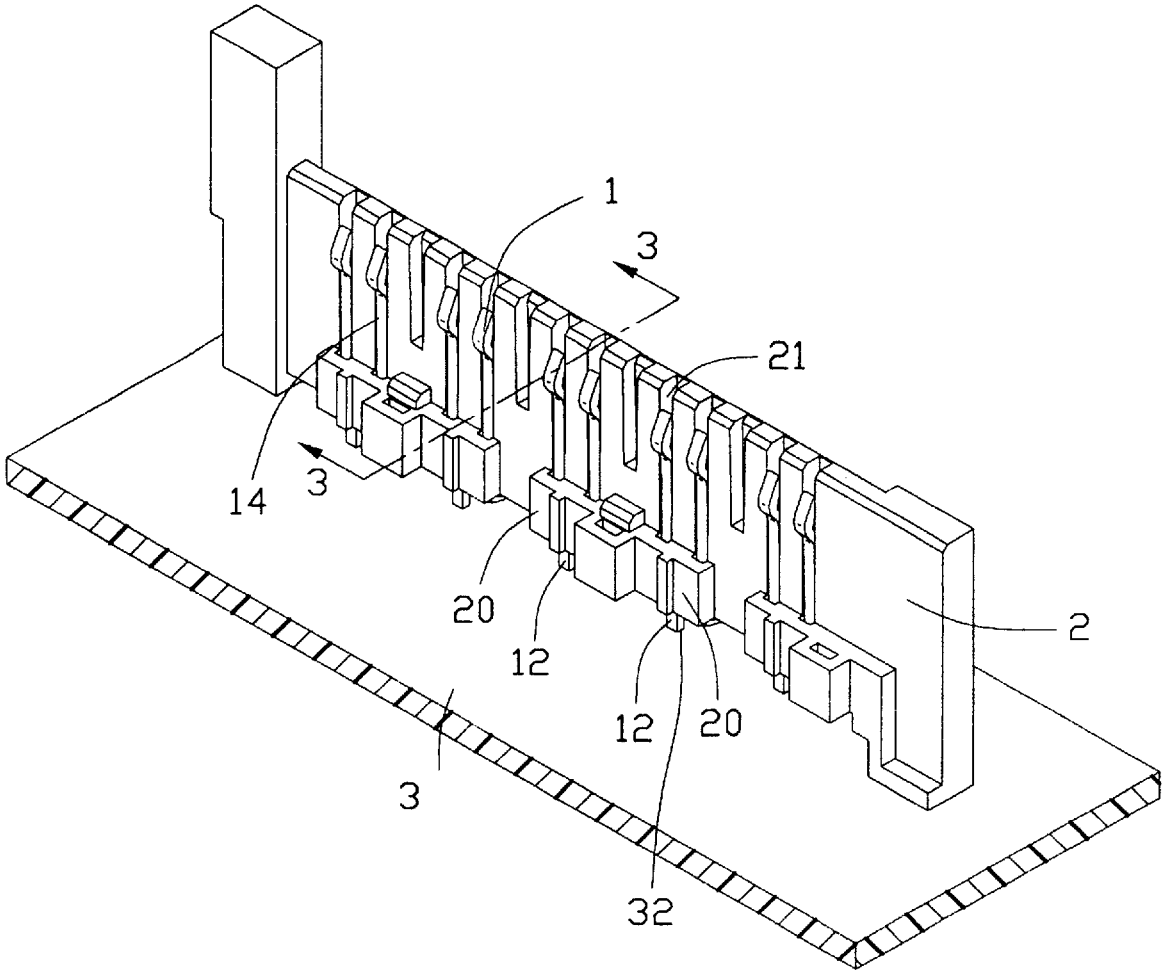
FIG. 2 a perspective view of a number of the electrical contact of FIG. 1 assembled in a dielectric wafer of an electrical connector mounted on a PCB, each of the contacts having a tail portion extending through a through hole of the PCB.

Referring to FIGS. 2 and 3, a dielectric wafer 2 in which a number of the contact 1 of FIG. 1 is mounted is shown. A plurality of the wafer 2 is assembled together to form a spacer which is retained in a housing to form a backplane electrical connector. Since the detailed disclosure for constructing the connector is irrelevant to the inventive feature of the present invention, the disclosure is omitted herein. The wafer 2 defines a plurality of passageways 21 receiving the contacts 1 therein. The passageways 21 extend from a bottom end to a top end of the wafer 2. A step portion 23 is formed in one sidewall 20 of the wafer 2 and located between every two adjacent passageways 21 and adjacent to the bottom end of the wafer 2.

In assembly, each of the contacts 1 is inserted into corresponding passageways 21 with the retaining portions 13 thereof engaged with the sidewall 20 of the wafer 2, the main portion 11 abutting against the step portion 23 to prevent the contact 1 from moving upwardly, and the arms 14 extending upwardly in the passageways 21. The contacting portions 141 of the arms 14 extend outside the passageway 21 for engaging with signal traces of a circuit board (not shown) in the connector. The compressive tail portion 15 is positioned downwardly beyond the passageways 21. When the wafer 2 with the contacts 1 is assembled to the printed circuit board 3, the wafer 2 is downwardly pressed toward the printed circuit board 3 so that the compressive tail portions 15 are compressed. The bulges 151 electrically connecting with conductive pads 31 on the printed circuit board (PCB) 3. The pin-like tail portions 12 located below the bottom end of the wafer 2 extend through holes 32 of the PCB 3. The pin-like tail portions 12 each have a length extending downwardly a bottom face 33 of the PCB. 3.

Figure 4:
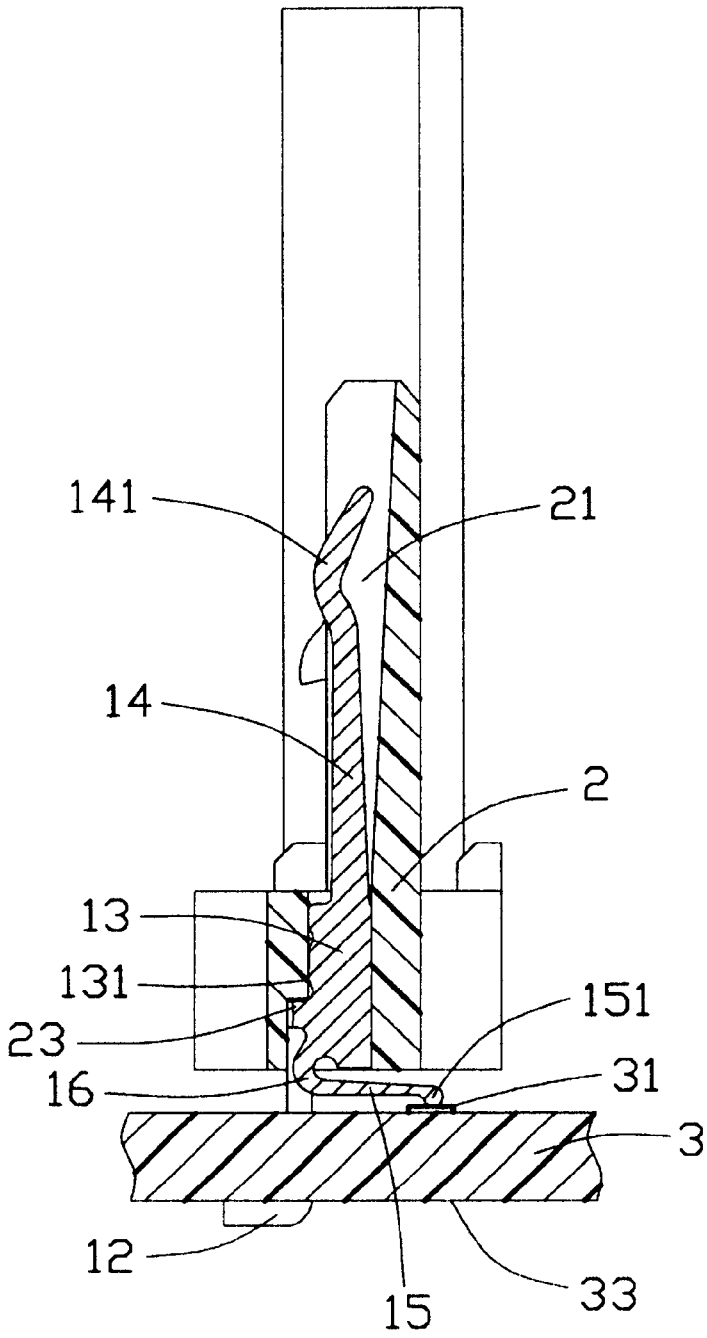
FIG. 4 is a similar view with the FIG. 3 after the tail portion is bent.

Referring to FIG. 4, finally, the part of the tail portions 12 extending beyond the bottom face 33 of the PCB 3 is bent perpendicularly to abuts against the bottom face 33 of the PCB 3. Thus, the contacts 1 and the wafer 2 are firmly assembled to the PCB 3 and the bulges 151 of the compressive tail portions 15 firmly engage with the conductive pads 31. The electrical connection between compressive tail portions 15 of the contacts 1 and the conductive pads 31 of the PCB 3 is reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A conductive contact adapted for being received in a dielectric wafer and electrically connecting with a printed circuit board (PCB), comprising:

a main portion;

a pair of retaining portions extending from a pair of ends of the main portion and substantially perpendicular to the main portion, the retaining portions being adapted to engage with the dielectric wafer and secure the contact to the dielectric wafer;

a pair of compressive tail portions extending from the retaining portions, adapted to electrically connect with conductive pads on the PCB;

a pair of arms expending upwardly from top ends of the retaining portions, adapted for electrically engaging with a circuit board;

a pin-like tail portion extending downwardly from the main portion and having a length adapted for extending through the PCB.

2. The conductive contact as described in claim 1, wherein the retaining portions each have a plurality of teeth formed on one side thereof, adapted for engaging with the wafer.

3. The conductive contact as described in claim 1, wherein the compressive tail portions each have a curved portion connecting with a corresponding retaining portion.

4. The conductive contact as described in claim 1, wherein each arm has a curved contacting portion at a top end thereof, adapted for electrically engaging with the circuit board.

5. The conductive contact as described in claim 1, wherein the pin-like tail portion extends downwardly from a middle of a lower edge of the main portion.

6. The conductive contact as described in claim 1, wherein the compressive tail portions each comprise a compressive point at a free end thereof, adapted for being pressed to contact a corresponding conductive pad on the PCB.

7. An electrical assembly comprising:

a printed circuit board (PCB) comprising a through hole through top and bottom faces thereof, and two conductive pads on the top face thereof;

a dielectric wafer mounted on the printed circuit board, defining a number of passageways therein;

a contact secured in the wafer, the contact comprising:

a main portion;

a pair of retaining portions extending from a pair of ends of the main portion and substantially perpendicular to the main portion, the retaining portions engaging with the dielectric wafer and securing the contact to the dielectric wafer;

a pair of compressive tail portions extending from the retaining portions and electrically connecting with the two conductive pads on the PCB;

a pair of arms expending upwardly from top ends of the retaining portions, adapted for electrically engaging with a circuit board;

a pin-like tail portion extending downwardly from the main portion and having a length extending through the through hole of the PCB, a part of the pin-like tail portion below the bottom face of the PCB being bent to tightly engage with the bottom face of the PCB thereby securing the contact with the wafer to the PCB.

8. The assembly as described in claim 7, wherein the retaining portions each have a plurality of teeth formed on one side thereof, engaging with the wafer.

9. The assembly as described in claim 7, wherein the compressive tail portions each have a curved portion connecting with a corresponding retaining portion.

10. The assembly as described in claim 7, wherein each arm has a curved contacting portion at a top end thereof, adapted for electrically engaging with the circuit board.

11. The assembly as described in claim 7, wherein the pin-like tail portion extends downwardly from a middle of a lower edge of the main portion.

12. The assembly as described in claim 7, wherein each of the compressive tail portions comprises a downward bulge at a free end thereof, the bulge being pressed to contact a corresponding conductive pad on the top face of the PCB.

13. An electrical assembly comprising:

a printed circuit board with a through hole and at least one conductive pad on an upper surface beside said hole;

a dielectric body seated upon said printed circuit board;

at least a contact retained in said dielectric body, said contact including:

a retaining portion for retaining the contact in the dielectric body, a compressible tail extending downwardly from said retaining portion with a free end abutting against the printed circuit board, a pin downwardly extending directly or indirectly from the retaining portion and spaced from the tail and through said through hole; wherein the pin is bent to abut against a bottom face of the printed circuit board so as to retain said body on the printed circuit board under a condition that the compressible tail is depressed.

* * * * *